United States Patent [19]

Matsuno et al.

[11] 4,306,831

[45] Dec. 22, 1981

[54] COKE OVEN DOOR OVERTURNING APPARATUS

[75] Inventors: Yasunobu Matsuno, Koshigaya; Kazunori Tokizawa, Tokyo, both of Japan

[73] Assignee: Koritsu Kikai Kogyo Company Limited, Tokyo, Japan

[21] Appl. No.: 64,070

[22] Filed: Aug. 6, 1979

[51] Int. Cl.[3] ..... C10B 25/14

[52] U.S. Cl. ..... 414/684.3; 414/780

[58] Field of Search ..... 414/684.3, 780; 212/166; 202/248; 15/93 A

[56] References Cited

U.S. PATENT DOCUMENTS

| | | | |
|---|---|---|---|
| 601,468 | 3/1898 | Hilgenstock | 212/166 X |
| 2,232,150 | 2/1941 | Timmerman | 212/166 |
| 3,191,778 | 6/1965 | Nestler | 212/166 |

FOREIGN PATENT DOCUMENTS

| | | | |
|---|---|---|---|
| 334077 | 8/1930 | United Kingdom | 414/684.3 |

*Primary Examiner*—H. Grant Skaggs
*Attorney, Agent, or Firm*—Charles E. Wills

[57] ABSTRACT

Coke oven door overturning apparatus of this invention provides lateral turning and leveling of a door laid down to be repaired, checked or otherwise treated. The apparatus comprises an electric winch for effecting up and down movement of the door turning apparatus of this invention provides lateral turning and leveling of a door laid down to be repaired, checked or otherwise treated. The apparatus comprises an electric winch for effecting up and down movement of the door through a wire cable leading to a door holding frame, a lifting device for leveling the door in the laid down condition, and a lateral turning device capable of rotating the door by 360 degrees in order that the door may be faced in any desired direction for treatment.

5 Claims, 7 Drawing Figures

COKE OVEN DOOR OVERTURNING APPARATUS

BACKGROUND OF THE INVENTION

This invention relates to a coke oven door overturning apparatus. Coke oven doors employed to close the pusher and coke sides of coke oven chambers from time to time require repair, checking or other treatment. At such times, the doors are individually removed from the oven chamber and carried to a door overturning apparatus by a door lifter on a pusher or coke guide car which runs along the pusher and coke sides of a coke oven battery. The overturning apparatus may be located near one side of the coke oven battery and is adapted to turn the door over about a horizontal axis to carry out the repair, checking or other treatment. However, conventional overturning apparatuses require complicated preparations for overturning and are difficult to operate. They also overturn the door on a horizontal platform high above the working floor, the platform tending to obstruct traffic on the working floor when not in use.

SUMMARY OF THE INVENTION

An object of the present invention is to provide an improved coke oven door overturning apparatus without the abovementioned drawbacks, which can be smoothly operated and is capable of laying down and raising a door very safely.

A further object of the present invention is to provide an improved coke oven door overturning apparatus which comprises a lifting device for leveling the door in the laid down condition, a lateral turning device capable of softly rolling the door by 360 degrees to permit the door surfaces to be faced in any desired directions for repair, checking or other treatment; and a pair of horizontal rails on the working floor which can be easily stepped over when the apparatus is not in use.

Briefly, a preferred embodiment of the coke oven door overturning apparatus according to this invention comprises at least one vertical setting stand founded on a working floor; a pair of floor rails founded on the working floor, end portions thereof inclined upwardly near the setting stand; a pair of guide rails on the inner walls of the setting stand, the lower portions thereof gradually diverging from the setting stand toward the floor rails; a door holding frame movably hung within the setting stand by a wire cable and having pairs of upper and lower side rollers riding on the guide rails and the floor rails, respectively, said holding frame further having pairs of upper and lower locking bar receiving members protruding outwardly from both sides thereof; an electric winch with the wire cable wound thereon, one end of the wire cable being fastened to an upper wall of the setting stand or directly to the holding frame to move the door holding frame up and down along the guide rails; a lifting device mounted to the lower end of the door holding frame with an actuating plate thereof associated with rods of hydraulic cylinders for leveling the door in a laid down condition; and a lateral turning device capable of softly rotating the door through 360 degrees in order that the frame and thus the door surface to be treated may be faced in any desired direction.

BRIEF DESCRIPTION OF THE DRAWINGS

This invention may best be understood by reference to the following description taken in connection with the accompanying drawings, in which.

Figure 7:
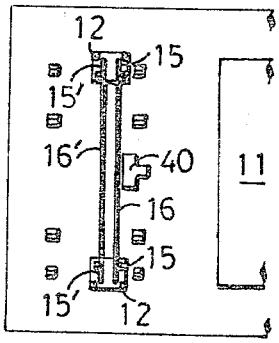
FIG. 7 is a schematic plan view showing an arrangement of the apparatus of this invention.

Referring now to the drawings, particularly to FIG. 7, a coke oven door overturning apparatus of this invention is shown mounted aside the coke oven battery 11 in parallel to oven chambers thereof. The door overturning apparatus may be also mounted at a central deck of the coke oven battery (not shown). As will be apparent from FIG. 7, the door overturning apparatus generally comprises a pair of opposed setting stands 12 and 12', a pair of parallel floor rails 16 and 16', and an electric winch 40. The setting stands 12 and 12' are located adjacent pusher and coke sides of the battery 11, respectively, each of the setting stands being able to handle one coke oven door. The pair of floor rails 16 and 16' extend between the setting stands 12 and 12', with both end portions 15 and 15' assending from the floor. Since the two setting stands 12 and 12' are symmetrical with respect to the electric winch 40, the following description will principally refer to only one side of the apparatus, namely, the setting stand 12, the pair of floor rails 16 and 16', and the electric winch 40.

Figure 1:
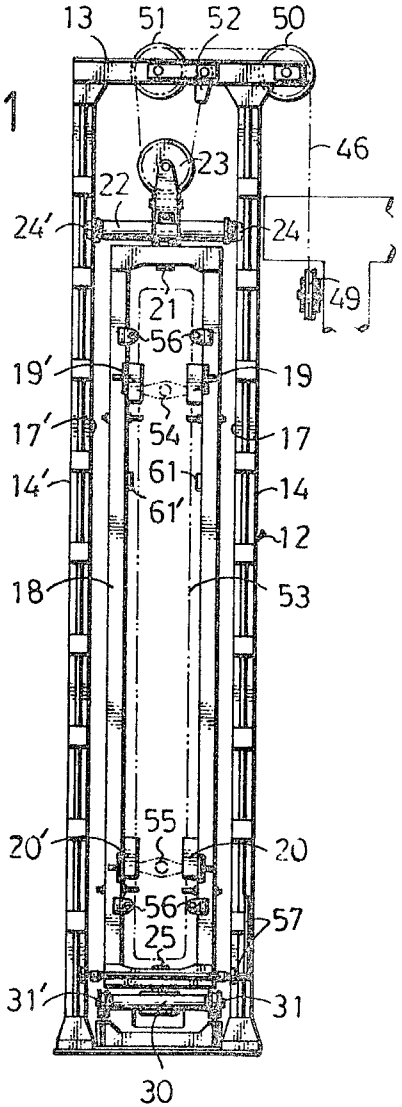
FIG. 1 is a front elevational view of a coke oven door overturning apparatus constructed in accordance with the present invention.
Figure 2:
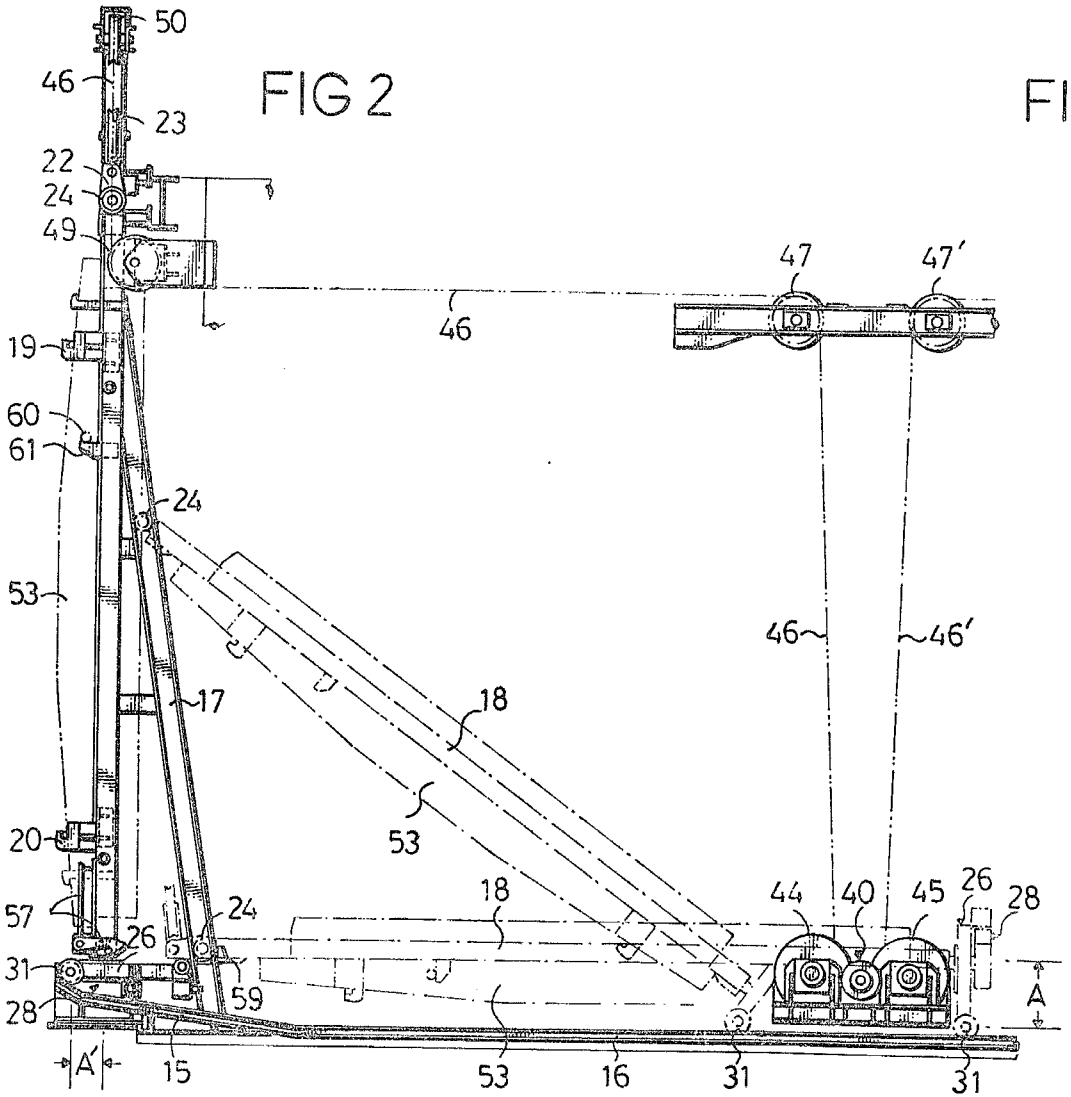
FIG. 2 is a fragmentary side view, partially broken away, of a portion of the apparatus of FIG. 1.

As shown in FIGS. 1 and 2, each of the setting stands is provided with a pair of vertical frames 14 and 14'. Guide rails 17 and 17' are positioned within the vertical frames 14 and 14', respectively, with the lower portion of each such guide rail diverging from the setting stand in the direction of the floor rails 16 and 16'. A frame 18 for holding a door 53 is hung within the setting stand 12, the frame 18 being provided with upper locking bar holders 19 and 19' and lower locking bar holders 20 and 20' projecting outwardly from the two sides thereof.

Figure 4:
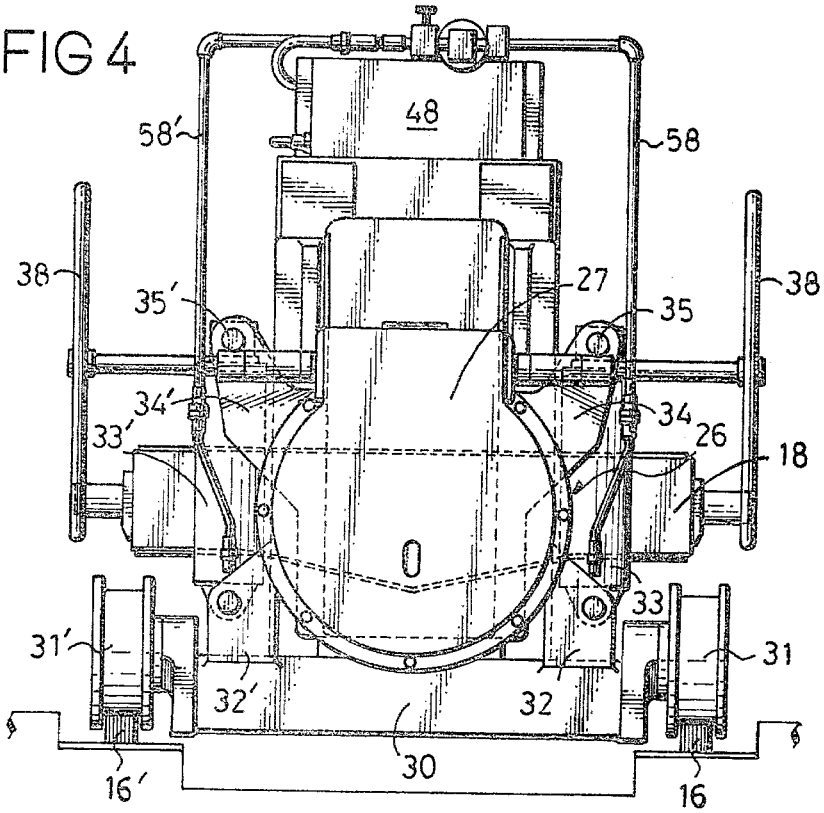
FIG. 4 is an enlarged front elevational view of a combined lateral turning and lifting device of this invention.
Figure 5:
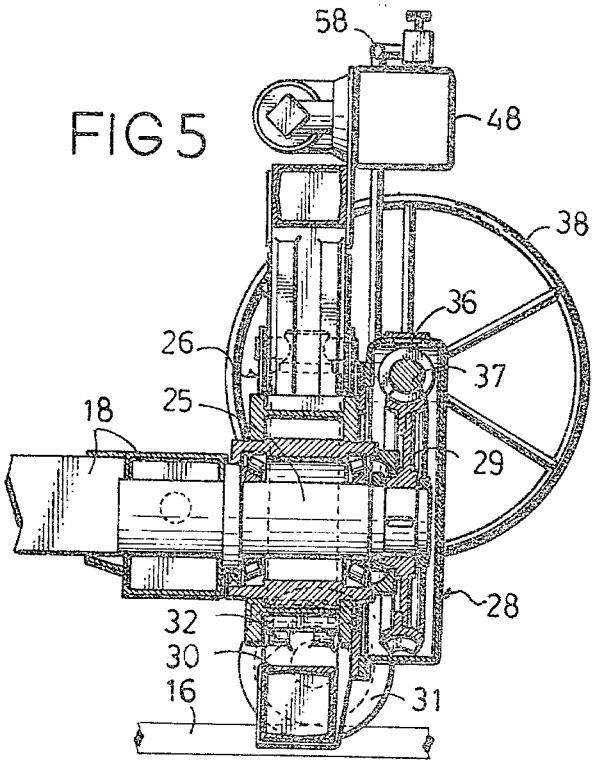
FIG. 5 is a side view of the device of FIG. 4.

The upper end of the frame 18 is rotatably connected to a roller axle 22 through a pivot joint 21. The roller axle 22 is provided at its two ends with rollers 24 and 24' engaging the guide rails 17 and 17', respectively, and carries a wire sheave or pulley 23 for hanging the door holding frame. The lower end of the door holding frame 18 is provided at the center thereof with a connecting rod 25, the rod 25 extending through an actuating plate 27 of a lifting device 26 and connecting to a worm gear 29 of a turning device 28 (FIGS. 4 and 5). A receiving member 30 is provided opposite the actuating plate 27, the two ends of the member 30 carrying lower wheels 31 and 31' which rotatably engage the ascending rails 15, 15'.

Figure 6:
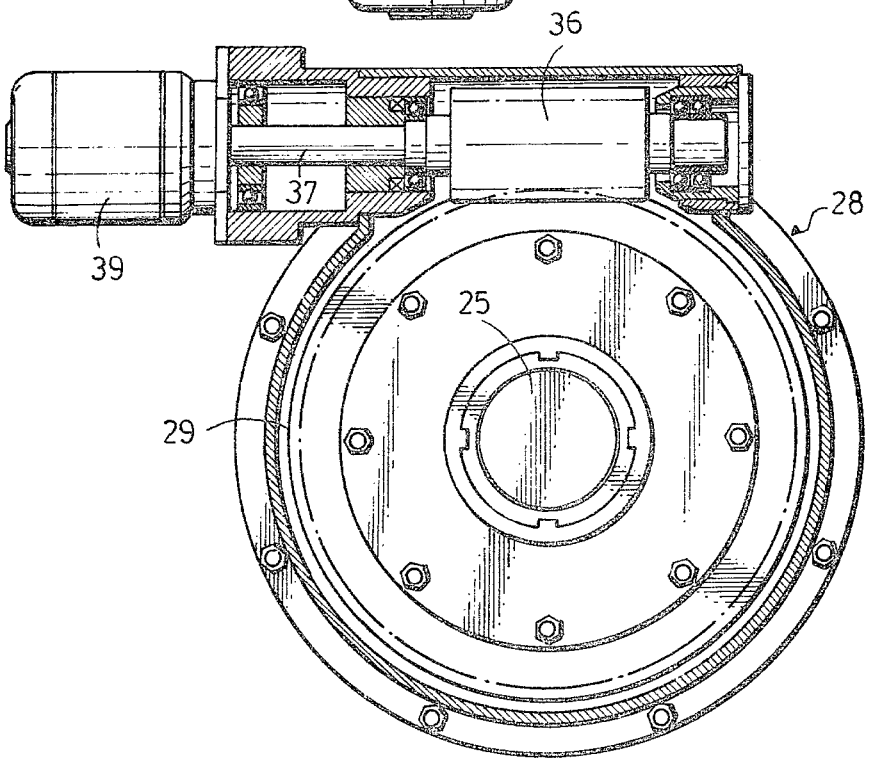
FIG. 6 is a side elevational view of a motorized lateral turning device constructed in accordance with another embodiment of the present invention.

As shown in FIGS. 4, 5 and 6, supporting plates 32 and 32' are fixed near the two ends of the receiving member 30 for mounting hydraulic cylinders 33 and 33', respectively. The cylinder rods 35 and 35' of the hydraulic cylinders 33 and 33' are connected to lugs 34 and 34' of the actuating plate 27 to permit the actuating plate 27 and the lateral turning device 28 to be lifted relative to the receiving member 30. The turning device 28 includes an axle 37 carrying a worm 36 for engagement with a worm gear 29. The axle 37 is provided at one end thereof with either a handwheel 38 for manual operation (FIGS. 4 and 5) or an electric motor 39 for power operation (FIG. 6). In FIGS. 4 and 5, the reference numeral 48 designates a tank of hydraulic fluid associated with the hydraulic cylinders 33 and 33', and the numerals 58 and 58' designate the appropriate fluid lines.

Figure 3:
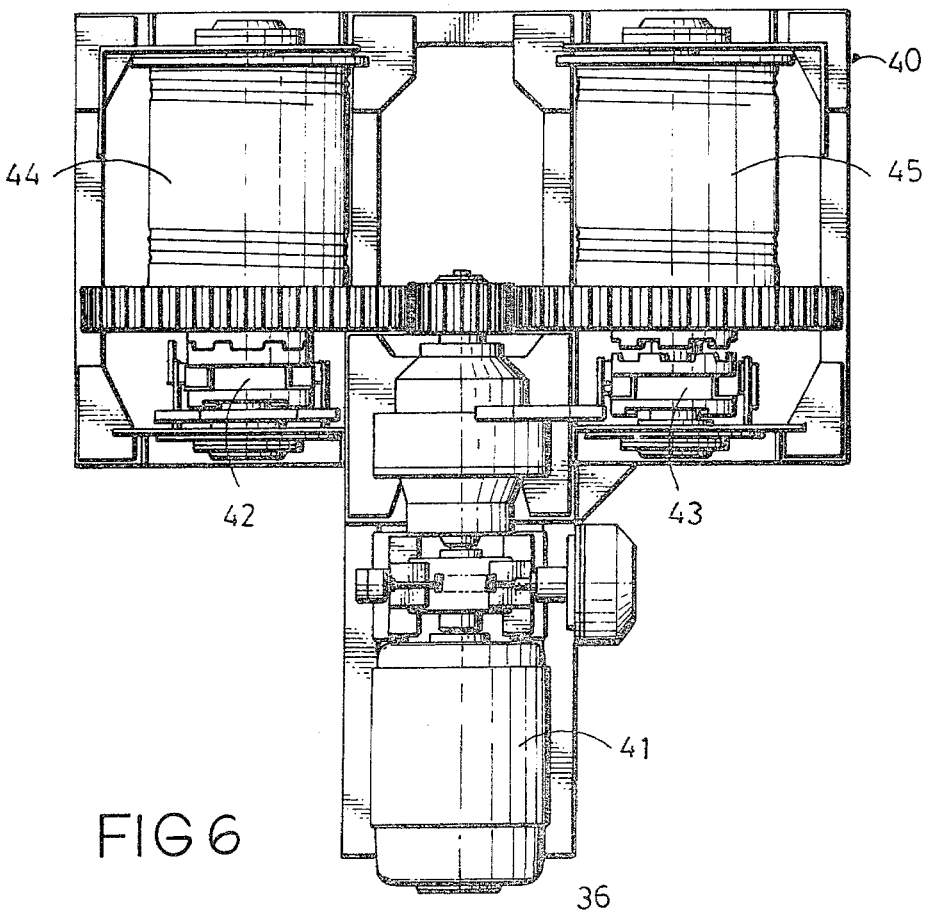
FIG. 3 is an enlarged plan view of an electric winch constructed in accordance with this invention.

As shown in FIG. 7, the electric winch 40 is positioned outside of the two floor rails 16 and 16'. In FIG. 3, the electric winch 40 comprises a reversible motor 41, clutches 42 and 43, and reversible wire drums 44 and 45 driven by the clutches 42 and 43, respectively. As shown in FIGS. 1 and 2, wire cables 46 and 46' are wound on the wire drums 44 and 45 and pass therefrom over wire sheaves 47 and 47', respectively. The wire cable 46' and wire sheave 47' serve for the second setting stand 12', which need not be described separately herein. As noted above, the setting stand 12' is symmetrical with the setting stand 12 with respect to the electric winch 40.

The wire cable 46 passes over the sheave 47 mounted above the winch 40, under a second sheave 49 mounted near the vertical frame, over third and fourth sheaves 50 and 51 mounted on the upper beam 13, and lastly under the hanging wire sheave 23 mounted on the roller axle 22. The remote end of the wire cable 46 is connected to a fastening member 52 on the upper beam of the setting stand 12.

In operation, the door 53 to be repaired, checked or otherwise treated is removed from the oven chamber and carried to the front of the setting stand 12 by a lifter (not shown) of a pusher or coke guide car. The door 53 is then placed on the door holding frame 18 with both ends of the upper and lower locking bar riding on the bar holders 19 and 20. The door itself is positively supported in the door holding frame 18 by hanging rollers 60 and 60', the rollers being carried at either side of the door 53 and resting on roller receiving pieces 61 of the door holding frame 18. The door 53 is locked in place by upper and lower stoppers 56 which are bolted to the holding frame 18. When it is desired to lay the door down, a locking piece 57 pivotably engaging the holding frame 18 is disengaged. Then, the electric motor 41 starts and engages with the clutch 42 which drives the wire drum 44 to release the wire cable 46. With the upper rollers 24 riding on the guide rails 17 and 17' and the lower rollers 31 riding on the ascending rails 15 and 15' of the floor rails 16 and 16', the door 53 can be smoothly laid down through the interim position shown in FIG. 2 until the upper rollers 24 and 24' reach a limit switch 59 which stops the motor 41. Because of the difference between distance A and distance A', the portion of the door 53 near the lower rollers 31 is lower than that near the upper rollers 24 and 24' when the door is initially laid down. This unlevel condition of the door 53 is remedied by causing the hydraulic cylinders 33 and 33' to raise the lower end of the door through the cylinder rods 35 and 35' and the lifting device 26, until the door assumes a level horizontal condition. The door can then be turned through any desired angle by rotating the hand-wheel 38 or by driving electric motor 39 (in case of FIG. 6), allowing the door to be easily repaired or checked. Since the door 53 is then in a horizonal laid down condition with a lateral turning axis at its center of gravity, the lateral turning is easily controlled with a minimum of force and can be carried out by hand.

After completion of the repairing or checking operation, the door 53 is turned laterally back to its original angular orientation and the raised lower portion of the door is relowered to its original position. The wire cable 46 is then rewound on the drum 44 to gradually raise the door and the door holding frame 18. After the door and the frame are fully raised, the frame 18 is locked in the upright condition by rotating the locking lever 57 to prevent further movement of the lower rollers 31. The door 53 can then be returned to its original location on the coke oven chamber by the lifter of the pusher or coke guide car.

We claim:

1. A coke oven door overturning apparatus which comprises in combination:

a vertical setting stand founded on a working floor;

a pair of floor rails founded on the working floor and having end portions inclined upwardly near the setting stand;

a pair of guide rails on the inner sides of the setting stand, the lower portions thereof gradually diverging from the setting stand in the direction of the floor rails;

a door holding frame able to receive a coke oven door, said frame being movably hung within the setting stand by a wire cable and having pairs of upper and lower side rollers riding on the guide rails and the floor rails, respectively, for movement of the frame from an upright to a laid down condition, the frame further having pairs of upper and lower locking bar receiving members protruding outwardly from both sides thereof to receive upper and lower bars able to hold a coke oven door in place on the frame;

a winch operatively connected with said wire cable to actuate the holding frame between said upright and said laid down conditions;

a lifting device mounted on the lower end of the holding frame, said lifting device having an actuating plate and a pair of hydraulic cylinder mechanisms, said actuating plate being associated with rods of the hydraulic cylinder mechanisms to adjust the height of said lower end of the holding frame when the frame is in said laid down condition; and a lateral turning device capable of rotating the frame through 360 degrees about a longitudinal axis such that the surface of a door held by the frame may be faced in any desired direction.

2. A coke oven door overturning apparatus according to claim 1, in which the wire cable by which the door holding frame is hung passes through a sheave pivotably fixed thereabove, the remote end of the wire cable being fastened to an upper beam of the setting stand.

3. A coke oven door overturning apparatus according to claim 1, in which the lateral turning device comprises a manually driven worm and meshing worm gear means.

4. A coke oven door overturning apparatus according to claim 1, in which the lateral turning device comprises an electrically driven worm and meshing worm gear means.

5. A coke oven door overturning apparatus according to claim 1, in which a limit switch is provided to control downward movement of the door.

* * * * *